US005676245A

United States Patent [19]

Jones

[11] Patent Number: 5,676,245

[45] Date of Patent: Oct. 14, 1997

[54] ARTICLE PACKAGING KIT, SYSTEM AND METHOD

[76] Inventor: William Charles Jones, 3 Ida La., East Sandwich, Mass. 02537

[21] Appl. No.: 626,497

[22] Filed: Apr. 2, 1996

[51] Int. Cl.[6] ..... B65D 69/00; B65D 71/00; B65D 81/02

[52] U.S. Cl. ..... 206/223; 53/441; 53/462; 206/466; 206/497; 206/583; 206/770

[58] Field of Search ..... 206/461, 464, 206/465, 466, 497, 583, 770, 223, 495; 53/441, 462

[56] References Cited

U.S. PATENT DOCUMENTS

| | | | |
|---|---|---|---|
| 2,124,324 | 7/1938 | Weeks | 206/466 X |
| 2,707,553 | 5/1955 | Yount . | |
| 2,745,545 | 5/1956 | Dunning | 206/466 |
| 2,802,565 | 8/1957 | Kabbash . | |
| 2,919,797 | 1/1960 | McCracken . | |
| 2,959,277 | 11/1960 | Strange | 206/466 |
| 2,980,245 | 4/1961 | Stoker, Jr. | 53/441 X |
| 3,089,590 | 5/1963 | Mell . | |
| 3,424,306 | 1/1969 | Munck . | |
| 3,434,646 | 3/1969 | Schmidt | 206/461 X |
| 3,507,383 | 4/1970 | Rorer . | |
| 3,540,579 | 11/1970 | Hellstrom . | |
| 3,562,999 | 2/1971 | Barbedienne | 53/441 |
| 3,669,337 | 6/1972 | Struble . | |
| 3,718,275 | 2/1973 | Willinger . | |
| 3,891,090 | 6/1975 | Spiegel et al. . | |
| 3,905,474 | 9/1975 | Haibara . | |
| 4,030,603 | 6/1977 | Angell . | |
| 4,285,432 | 8/1981 | deVillers et al. . | |
| 4,307,804 | 12/1981 | Benham | 206/497 |
| 4,494,689 | 1/1985 | Ilitch . | |
| 5,086,925 | 2/1992 | Coalier et al. . | |
| 5,323,896 | 6/1994 | Jones | 206/223 |
| 5,338,701 | 8/1994 | Ridgeway . | |

FOREIGN PATENT DOCUMENTS

| | | |
|---|---|---|
| 691904 | 8/1964 | Canada . |
| 57-177969 | 11/1952 | Japan . |
| 49-59982 | 5/1974 | Japan . |
| 49-77087 | 7/1974 | Japan . |
| 50-88376 | 7/1975 | Japan . |
| 50-102778 | 8/1975 | Japan . |
| 50-107583 | 9/1975 | Japan . |
| 3-100158 | 10/1991 | Japan . |

*Primary Examiner*—Bryon P. Gehman
*Attorney, Agent, or Firm*—Richard P. Crowley

[57] ABSTRACT

A packaging kit for the immobilization of an article to be shipped, which kit comprises a base sheet of selected width and length sufficient to hold the article being packaged, the base sheet characterized by a horizontal fold line extending substantially across the base sheet, which permits the base portion to be folded inwardly to receive an article to be packaged on the base sheet. The sheet has a pair of spaced-apart opposite end portions having two or three parallel spaced-apart fold lines perpendicular to the horizontal central fold line, the fold lines adapted to move the end portions between a generally flat position and a folded V-shape or Z-shape position. The base sheet has at least two pairs of spaced-apart aligned notches on either side of the base portion. The kit includes a film tube material of selected dimensions and length, adapted to cover at least a substantial portion of the article to be immobilized on the base portion, and having a one and other end, which ends are folded around the ends of the article, and then tucked into the side notches on the base sheet, thereby completely immobilizing the article. The end portions are then folded to further immobilize the article and provide for a secure, suspended shipping position for the article within a shipping container.

21 Claims, 3 Drawing Sheets

ARTICLE PACKAGING KIT, SYSTEM AND METHOD

BACKGROUND OF THE INVENTION

There are a wide variety of packaging kits, systems and methods for the immobilization of articles in packaging, particularly fragile or odd-shaped articles, and for arranging the packaged articles in an outside container for shipment.

One article packaging kit, system and method is described in U.S. Pat. No. 5,323,896, issued Jun. 28, 1994, hereby incorporated by reference in its entirety. This patent describes a unique packaging kit for the immobilization of an article to be packaged, such as to be placed within another container. The kit comprises a relatively stiff sheet material, such as a corrugated cardboard of defined width and length, having a base portion to hold the article. The end portions on opposite sides of the base portion each have a fold line to define and permit the end portions to move between a generally non-use flat position and a folded position. The base also includes another fold line, perpendicular to the end fold lines and generally centrally positioned to permit the base portion to be folded. The kit includes a means, including a film tube comprised of a plastic sheet material, dimensioned and adapted to be placed about the stiff sheet material base portion, and to fit loosely around the base. The kit provides, after the article is inserted on the base portion in between the base portion and the film sheet material, for the film material to immobilize the packaged article by hugging the article on the base portion, such as clinging by a tension-clinging relationship to the article. This article packaging kit, system and method is simple, easy, effective, safe and the components are easily recyclable to provide for an improved packaging kit, system and method.

U.S. Pat. No. 3,905,474, issued Sep. 16, 1975, relates to a packing device which is comprised of a base sheet material having a fold line, and employs a plastic film sheet in an overlying relationship on the base sheet; however, the opposite ends of the plastic film sheet are secured to the base sheet. Bending the base sheet at the fold line forms a space between the secured ends of the plastic film, wherein the article is inserted, and then the base sheet is bent by means of the fold line in an opposite direction, to draw the plastic film taut over the base sheet to immobilize the article. This device, with a specific length of plastic film, limits the dimensions of the article to be immobilized, and the components of the packaging kit are not wholly recyclable, without additional effort to remove the film material from the base sheet.

It is therefore desired to provide for a new, easy effective and also recyclable improved packaging kit, system and method, which avoids the limitations of the prior art systems, and provides for the immobilization, particularly of articles, or articles of varying height, sizes and shapes, while placing the immobilized articles within an outer container for shipment.

SUMMARY OF THE INVENTION

The invention relates to a packaging kit, system and method for the immobilizing of an article, particularly for use for placing the immobilized article in an outer container.

The invention relates to a packaging kit, system and method, wherein the packaging kit is designed for the immobilization of an article, usually to be packaged in a separate container. The kit comprises a stiff sheet material, like a corrugated or cardboard-type material of defined width and length, sufficient to hold the article to be packaged. The sheet material has a base portion, and the sheet material is characterized by at least one longitudinal or horizontal fold line across the sheet material to permit the base portion to be folded inwardly in a manner to receive an article to be packaged on the base portion. The sheet material has notches on the base portion along the outer edges parallel to the horizontal fold line and spaced-apart end portions with at least a pair of lateral or vertical fold lines between the base portion and the end portions. The end portions are adapted to move between a generally flat position and a folded position, such as a folded up or folded down position, to immobilize the packaged article on the base portion.

The sheet material includes generally parallel vertical fold lines to define opposite end portions at each end of the base. The sheet material may include in a preferred embodiment a plurality of spaced-apart generally parallel (for example two or three) fold lines at each opposite end, so that the end portion of the sheet material may be folded downwardly to form a suspension-type base portion, with the end portions folded downwardly once or twice in a V-shape or Z-shape to suspend or hold the base portion above the bottom of the container in which it is to be placed. The end portions may also be folded upwardly to provide further surrounding protection to the immobilized article on the base portion or folded downwardly to provide a platform base portion for display of the immobilized article where a transparent film tube is used. Any combination of upward and downward folds may be employed as desired for a selected use.

The packaging kit of the invention includes a securing means including a tube film material of selected dimensions, to fit about the base portion of the base sheet material. The film tube material may be a transparent or nontransparent, foam or non-foam thin sheet material employed for packaging and having a length, for example a selected length of a portion or all of the base portion or a length together with the end portion, or a much longer length, and of a sufficient diameter to place about and to cover the article to be immobilized when the article is placed on the base portion. The film tube material is typically a tension-clinging film material, and generally a thermoplastic thin film tube material, that may be cut or dimensioned to a selected length, and, in a preferred embodiment, is slightly greater than the general length of the article to be immobilized on the base portion.

The base portion has outside side edges, generally parallel edges that are characterized by at least one pair of notches on the opposite edges and generally at least two pairs of notches each longitudinally spatially separated toward each end of the base portion. In one embodiment, the base portion has a plurality of selected spaced-apart notches on each outside edge, with the opposite notches generally aligned. The notches may vary in depth and shape, but are designed to receive therein and to retain the gathered end or ends of the film tube material in the selected notch portion and to have the gathered film tube ends extend across the base portion. The gathered retained film tube ends gathered within the notches at each end of the film tube provide a quick and easy means to retain the film tube material in the use position to immobilize the article. The gathered retained ends of the film tube material are placed in notches near the ends of the article and prevent the longitudinal or horizontal movement of the article on the base portion and provide enhanced protection to the packaged article. The use of selected spaced-apart notches permits the film tube to have a selected length, which position of the notches allows the film tube to be gathered at about the end of the article. This technique of retaining articles on the base portion is particularly suitable for low profile heavy articles which may slide or move even if surrounded in the use position with a film clinging film tube material. The gathered film tube ends provide additional strength at the end and the film tube ends extend outwardly in contact with and across the surface of the base portion.

In operation, the packaging kit provides for creasing the longitudinal fold line, typically a center fold line on the base portion, which base portion may have other fold lines, and inserting the base sheet into the film tube. The user then inserts the article to be inserted onto the creased base portion, and within the surrounding film tube material. The base sheet is then flattened at the central horizontal fold line. The film tube material is then gathered up at each end where the film tube material has a length greater than the article and the gathered film tube material is inserted into the side notches at each end of the base portion nearest the ends of the article. The use of a plurality of side notches on the base in a selected open spaced-apart position permits articles of different length to be accommodated with a single length film tube material. The opposite end portions may then be folded up or down, or any combination thereof, to flatten the base portion and increase the tension on the film material, and to stretch the film tube material and place the film tube material in a taut immobilization position about and to cling to the article on the base portion. The folded end portions thus form a support for the base portion in a shipping container or for display. The end portions may serve as a spacer within an outside container, or, as desired, the end portions can be completely folded down and under and rendered parallel to the underside of the base portion for additional support under the base portion.

The packaging kit, system and method of the invention is advantageous in that it can be composed of few in number and of simple components, and is easily employed and assembled to immobilize an article. In particular, the components are all recyclable, that is, the sheet material, which may be a stiff cardboard, and the film tube material may be reused. Further and importantly, the packaging kit permits the immobilization of articles of varying length, or a plurality of articles, since the length of the film tube material may vary depending upon the length of the article to be immobilized, or be standard, such as the length of the base portion. Also of importance is that the ends of the film tube material may be tucked under the ends of the article to be immobilized prior to being retained in place, and prior to the end portions being folded to immobilize the article, with such additional film as required for further immobilization.

Another advantage of the packaging kit is that the end portions may be folded downwardly, at about a 90 degree angle, prior to insertion in a shipping container and box, and thus position the immobilized article on the base portion above the bottom level of the box, that is, to suspend the base portion, and with the bottom level of the box, if desirable, containing insulating or cushioning materials, such as loose fill or foam, or even another item to be shipped. It is recognized that loose film, foam, paper and other packaging and insulating material to prevent damage to the immobilized article may be secured not only below the base portion, but about all sides of the fully immobilized article after being placed in the box and the box sealed for packaging and shipping. Further, a plurality of article packaging kits of a selected dimension may be vertically stacked inside the shipping container if desired.

The base sheet material useful in the kit, system and method may comprise any type of relatively stiff or hard supportable sheet-type material, and is particularly adapted for use with paper or corrugated cardboard-type material, where one or more horizontal, for example parallel, and two or more pairs of vertical fold lines may be easily imparted to the sheet material, for example, by a prescoring technique to permit easy folding of the base sheet material. The base sheet material may vary in dimensions, but typically has an elongated rectangular or square shape, and preferably having opposite end portions connected to the base portion at the fold lines. The sheet material does require at least one horizontal or longitudinal fold line, so that the sheet material in the base portion may be creased in order to insert the article to be immobilized within the loose surrounding film tube material, and generally includes two or more spaced-apart parallel vertical fold lines to define the end portions.

The film tube sheet material employed with the stiff sheet material to form the kit may be selected from a wide variety of materials, but generally comprises paper, foam or plastic materials in sleeve or tube form, or length-type form, say, for example, from a tubular roll and which may be employed and preferably is slightly stretchable or article form-hugging in use, so that it may hug and immobilize an article on the base portion of the sheet material when subject to tension by means of flattening the base portion by the folding of one or more of the opposite end portions. Such film material includes, but is not limited to, tear-resistant plastic heat oriented film-type material, for example, urethane, olefinic, vinyl and vinyl-type films, more particularly a polyethylene film tube material. The film thickness, of course, may vary as desired, and generally ranges from 1 to 20 mils, or, for example, from 1 to 2 up to 10 mils. Usually, the film tube material is of a transparent plastic material, so that the immobilized article may be visually observed during immobilization, and particularly where the immobilized article is displayed for resale purpose in the immobilized condition. The film material, may, of course, comprise a foam type or air bubble type of film material.

The film tube material is cut in the tube form to a desired length that usually extends and fits over a sufficient portion of the article, and over a majority of the length of the base portion of sufficient length to permit the ends of the film tube material to be tucked into the side notches to immobilize the article, and extends in diameter at least the width of the article on the base portion. Where desired, the film material may be doubled up to extend beyond the length of the base portion of the sheet material. In any event, the film material extends at least over one or both end portions.

The kit optionally includes an outer container or box, in which the immobilized article on the stiff sheet material may be inserted and then contained, sealed, packaged and shipped or displayed, along with optionally other packaging material or articles to be shipped.

Where end portions are in the stiff sheet material, the end portions then may be folded upwardly or downwardly, or a combination thereof, and then the entire assembly inserted in a container box for shipment.

The invention will be described for the purposes of illustration only in connection with certain preferred embodiments; however, it is recognized that those persons skilled in the art may make various modifications, changes, improvements and additions to the illustrated embodiments shown, all without departing from the spirit and scope of the invention.

DETAILED DESCRIPTION OF THE DRAWINGS

Figure 1:
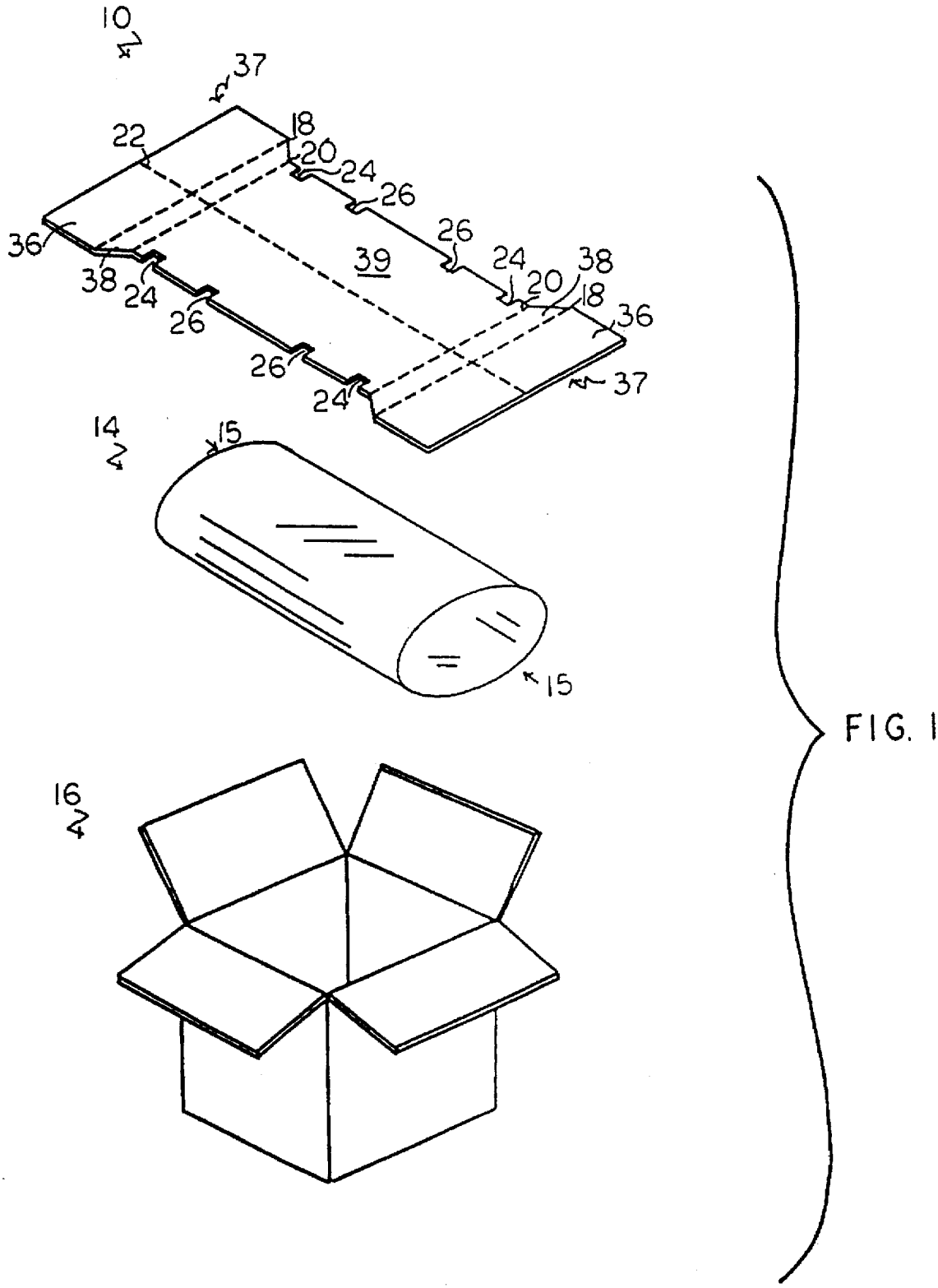
FIG. 1 is a perspective view from above of the article packaging kit and system of the invention.

In the drawings, FIG. 1 shows the article packaging kit of the invention 10 with a corrugated cardboard-type base sheet 12, a plastic retaining sheet 14 comprised of a polyethylene film tube material, and a corrugated cardboard-type shipping container 16. The base sheet 12 has a central base portion 39 with two pairs of outer outside notches 24 and inner outside notches 26. End portions 37 extend outwardly at opposite ends of the central base portion 39, the end portions having outer portion sections 36 and inner portion sections 38, formed by lateral fold lines 18 and 20. A longitudinal-fold line 22 is centrally located and extends across the entire base section 12 perpendicular to vertical fold lines 18 and 20. The film tube material 14 is shown with open ends 15.

Figure 2:
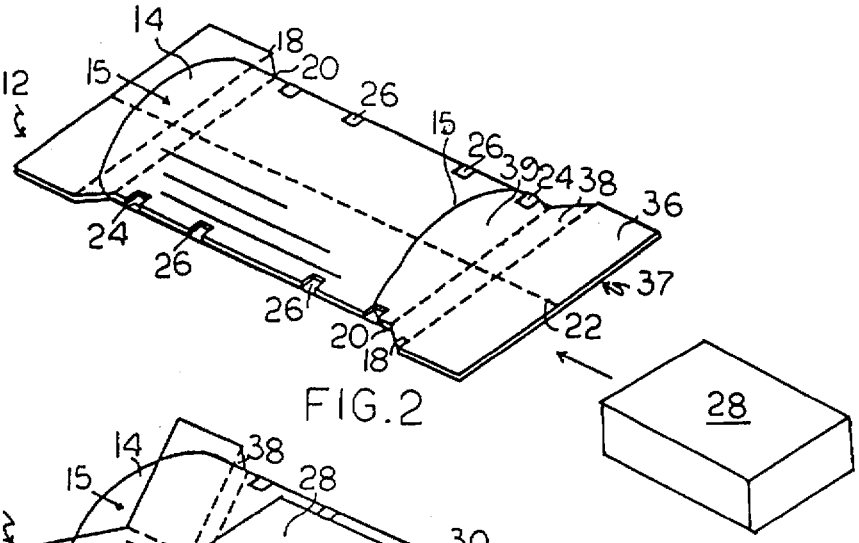
FIG. 2 is a perspective view from above of the invention of FIG. 1 in a prepackaging position with an article to be packaged.

FIG. 2 shows the invention of FIG. 1 in an assembled position prior to use, with the base section 12 inserted into the film tube material 14 through an open end 15. A lap top computer 28 is shown in position prior to insertion.

Figure 3:
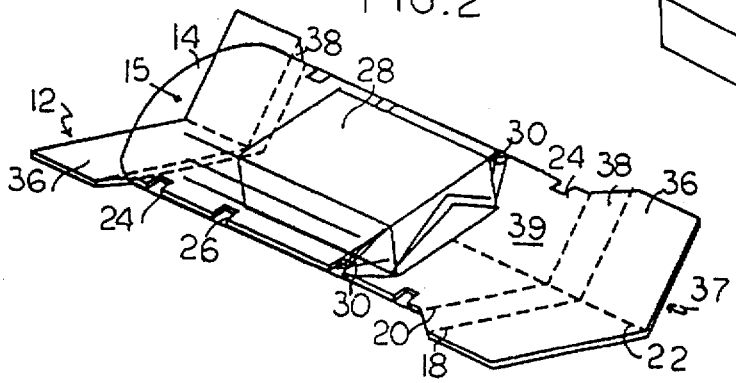
FIG. 3 is a perspective view from above of the invention of FIG. 1 with an article inserted therein.

FIG. 3 shows the invention of FIG. 1 with the lap top computer 28 inserted within the film tube material 14 on the base sheet 12. The base sheet 12 is folded inwardly along the longitudinal fold line 22 to relax the film tube material 14 and allow insertion of the lap top computer 28 between the film tube material 14 and the base portion 39. The film tube material 14 is shown gathered at one end with the gathers 30 tucked into inner outside side notches 26.

Figure 4:
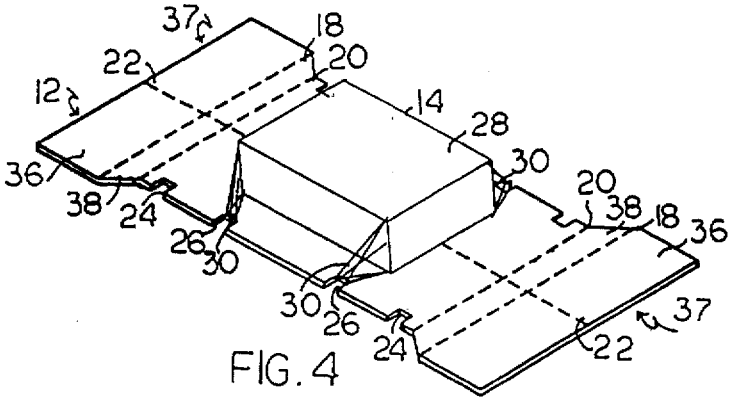
FIG. 4 is a perspective view from above of the invention of FIG. 1 with an article inserted and secured therein.

FIG. 4 shows the invention of FIG. 1 with the lap top computer 28 in an immobilized position on the base portion 39 of the base sheet 12. The film tube material 14 is gathered on each end of the lap top computer 28 and tucked into the inner outside side notches 26 to secure and completely immobilize the lap top computer 28 on the base portion 39. The base sheet 12 is flattened by outwardly folding the longitudinal fold line 22 to tighten the film tube material 14 and further secure the lap top computer 28 to the base portion 39.

Figure 5:
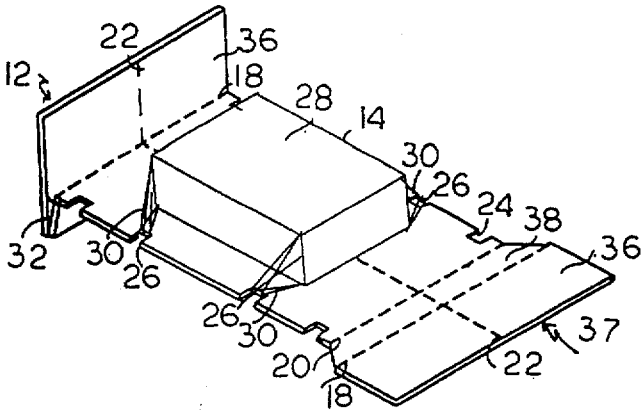
FIG. 5 is a perspective view from above of the invention of FIG. 1 with a package inserted and secured therein and one side folded prior to being placed in the shipping container.

FIG. 5 shows the secured and immobilized article of FIG. 4 with one end portion 37 folded in a V-shape 32 prior to being placed in the shipping container 16 (not shown). The middle portion 38 of the end portion 37 is folded downwardly along inner lateral fold line 20. Next, the outer portion 36 of the end portion 37 is folded upwardly along outer lateral fold line 18 to form the V-shape fold 32.

Figure 6:
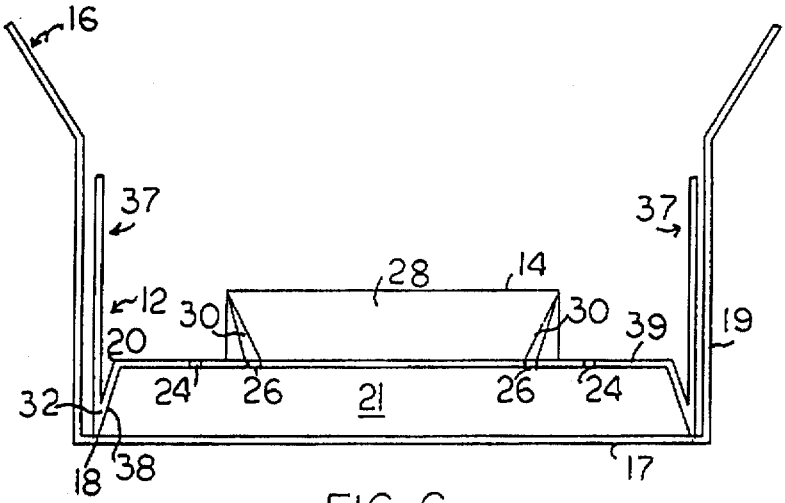
FIG. 6 is a side sectional view of the packaging kit with the base sheet of FIG. 1 in a V-shape folded configuration inside a shipping container.

FIG. 6 shows a side sectional view of the article packaging kit of FIG. 1 in an assembled position. The lap top computer 28 is secured and completely immobilized on the central base portion 39 of the base sheet 12 by the film tube material 14, which extends around the lap top computer 28. The film tube material 14 is gathered at each end of the lap top computer 28 and the gathered ends 30 are tucked into inner outside notches 26. The end portions 37 are shown folded into V-shape folds 32, with the middle portions 38 of end portions 37 folded downwardly along inner lateral fold lines 20, and the outer portions 36 of end portions 37 folded upwardly along outer lateral fold lines 18. The folded base sheet 12 is shown within a shipping container 16, with the V-shape folds 32 shown being retained in place by the sides 19 of the container 16 and forming a cushion space 21 under the lap top computer 28.

Figure 7:
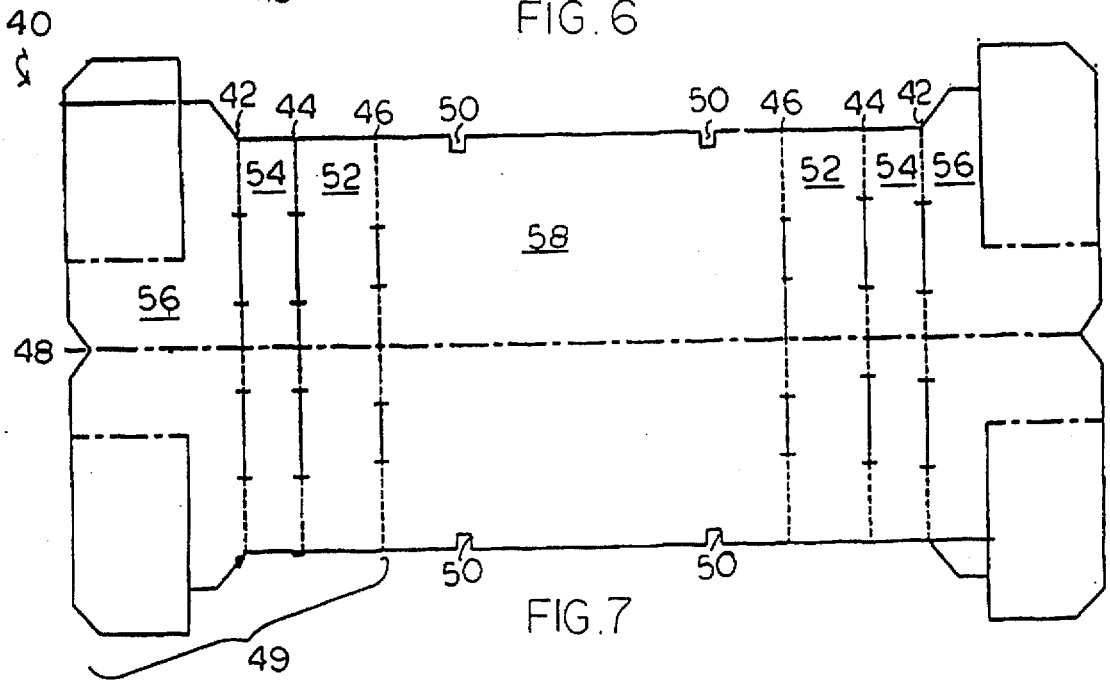
FIG. 7 is a top plan view of another embodiment of the base sheet of FIG. 1.

FIG. 7 shows a top plan view of another embodiment 40 of the base sheet of the packaging kit of the invention. The base sheet 40 has a central base portion 58, two pairs of parallel spaced-apart outside notches 50 on either side, and end portions 49 extending from opposite ends of the central base portion 58. Each end portion has an inner portion 52, a middle portion 54 and an outer portion 56 formed by vertical fold lines 46, 44 and 42 respectively. A longitudinal fold line 48 is centrally located and extends across the entire base section 40 perpendicular to vertical fold lines 42, 44 and 46.

Figure 8:
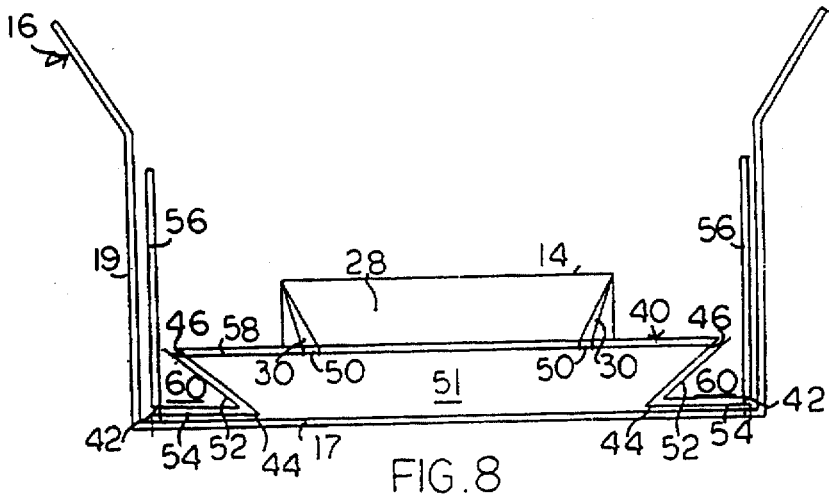
FIG. 8 is a side sectional view of the packaging kit with the base sheet of FIG. 6 in a Z-shape folded configuration inside a shipping container.

FIG. 8 shows the base sheet 40 of FIG. 7 in an assembled and packaged position inside a shipping container 16. The lap top computer 28 is secured and completely immobilized on the central base portion 58 of the base sheet 40 by the film tube material 14, which extends around the lap top computer 28, and which film tube material 14 is gathered at each end and the gathers 30 tucked into outside notches 50. The end portions 49 are shown folded into Z-shape folds 60, with the inner portions 52 of the end portions 49 folded inwardly along inner lateral fold lines 46, the middle portions 54 folded for parallel alignment to the bottom of the container 17 by outwardly folding lateral fold lines 44, and outer portions 56 folded to be aligned parallel to the sides 19 of the container 16 by upwardly folding lateral fold lines 42. The folded base sheet 40 is inserted into a shipping container 16, with the Z-shape folds 60 shown retained in place by the bottom 17 and sides 19 of the container 16 and forming a cushion space 51 under the lap top computer 28.

In use, the article packaging kit of the invention is purchased in a kit form and assembled with the article to be packaged. The base sheet is folded inwardly along the horizontal line bisecting the base sheet and inserted within the film tube material 14 through one of the open ends 15. Next, the article to be shipped is inserted between the plastic tubular sheet and the longitudinally folded base sheet. The open ends 15 of the film tube material 14 are then gathered and folded under the article to be shipped. The gathered portions are then tucked into selected outside side notches, making secure tucks at the front and back of the article to secure and completely immobilize the article to the base portion. The base sheet is then folded outwardly in a reverse fashion to flatten the base sheet and tighten the plastic tubular sheet around the sides of the article to secure it to the base portion.

With either embodiment of the base sheet, the base sheet is then folded in either a V-shape or Z-shape fold and inserted into the container for shipping. These unique fold-shapes provide suspension of the base portion and allow for additional protection of the secured article to be shipped inside the container.

Thus, the article packaging kit system and method of the invention provides for an easy to use, lightweight, flexible and versatile packaging kit, that can contain and immobilize a variety of articles, including one or a plurality of articles of the same or different shapes, sizes and compositions. The kit itself may be produced in a variety of shapes and sizes as desired by the manufacturer for the desired intended use. Further, the unassembled kit is easy to transport and store, and each part is reusable and recyclable either together or for separate uses.

What is claimed is:

1. A packaging kit for the immobilization of an article to be packaged, which kit comprises in combination:

a) a relatively stiff sheet material of defined width and length, having a base portion to hold the article, and having opposite outside edges, and end portions on opposite ends of said base portion adapted to be folded relative to said base portion, said sheet material having a longitudinal fold line to permit said sheet material to move between a first, generally flat position and a second folded article insertion position and having first and second spaced-apart, generally parallel lateral fold lines, said end portions adapted to move between a generally non-use flat position and a folded, article-immobilization use position;

b) a film tube means to extend about said base portion in a generally loose fit, when said sheet material is in said flat non-use position, and to fit snugly about the article on said base portion in said article-immobilization position; and c) wherein said outside edges of said base portion are characterized by a plurality of spaced-apart notches on each out side edge, said notches arranged and constructed to receive and retain therein the respective ends of said film tube thereby restricting the movement of the immobilized article on said base portion.

2. The kit of claim 1 wherein said sheet material includes said longitudinal fold line extending centrally of said sheet material and substantially the length of said sheet material and wherein said end portions are generally equal in length.

3. The kit of claim 1 wherein said film tube means has a length which is about said length of said base portion.

4. The kit of claim 1 wherein said film tube means has a length slightly greater than said length of said base portion.

5. The kit of claim 1 wherein said film tube means comprises a thin plastic film selected from the group consisting of: olefinic, vinyl and urethane films, wherein said film tube means comprises a plastic film formed into a film tube and said plastic film has a film thickness of about 1 to 20 mils.

6. The kit of claim 1 wherein said end portions are adapted to be folded upwardly to form opposite sides about the article or downwardly to support said base portion.

7. The kit of claim 6 wherein said sheet material contains at least one additional pair of generally parallel spaced apart lateral fold lines to form a pair of end portions at each end of the base portion and to permit the end portions at each end to be separately folded.

8. The kit of claim 1 wherein said lateral fold lines extend generally across said width of said sheet material and said longitudinal fold line extends centrally substantially along said length of said sheet material.

9. The kit of claim 1 wherein said notches comprise four spaced-apart pairs of notches, with two pairs of notches positioned toward each end of said base portion to permit adjustment of said film tube means to the length of the article to be immobilized.

10. The kit of claim 1 wherein said notches on one out edge side are generally oppositely aligned with notches on the opposite out edge side.

11. The kit of claim 1 wherein said notches have a generally U-shape.

12. The kit of claim 1 wherein said lateral fold lines comprise three generally parallel spaced-apart fold lines at each end of said base portion to permit each end portion to be folded downwardly in a generally Z-shape to support said base portion.

13. The kit of claim 1 which includes a container for the insertion of the immobilized article on said base portion.

14. The kit of claim 1 which includes an article in a use-immobilized position on said base portion of said sheet material.

15. A method for the immobilization of an article, which method comprises:

a) providing a stiff sheet material, sufficient to hold the article to be immobilized, having a base portion with first and second ends and outside edges and characterized by a longitudinal fold line extending across said base portion to permit said base portion to be folded inwardly, and having spaced-apart opposite end portions with lateral fold lines, so that said end portions may move between a generally flat use position and a folded position;

b) providing a film tube dimensioned in length and diameter and having ends and adapted to be placed about said exterior of said base portion, in a generally loose fit when said sheet material is in a non-use flat position, and to fit snugly about the article on the base portion in an article-immobilization position; and c) wherein the outside side edges of said base portion are characterized by a plurality of spaced-apart notches on each outside side edge, said notches arranged and constructed to receive and retain therein the respective ends of said film tube thereby retaining the movement of the immobilized article on said base portion;

d) folding the base portion along the longitudinal fold line and inserting the article to be immobilized within said film tube on said base portion;

e) inserting and retaining said ends of said film tube into said notches; and f) folding said end portions to place the base portion in a flat use position wherein the film tube surrounding said base portion moves into a tension clinging position about the article to immobilize the article on said base portion.

16. The method of claim 15 wherein said sheet material comprises a relatively stiff, corrugated cardboard sheet material and which includes said longitudinal fold line generally centrally positioned extending along said length of said base portion and generally perpendicular to at least two spaced-apart lateral fold lines which define said end portions, and folding said sheet material into an article-inserting position along the longitudinal fold line and folding said end portions to a position of about 90° from said base portion.

17. The method of claim 15 which includes placing the immobilized article with said end portions folded into a container of similar dimensions as said base portion.

18. The method of claim 15 wherein said film tube comprises a single thin flexible transparent stretchable plastic film tube.

19. The method of claim 15 which includes positioning the notches on said outside edges toward said first and second ends of said base portion with said notches on one outside edge generally aligned with said notches of said other outside edge, and gathering the ends of said film tube material and inserting said gathered ends in the notches to retain the article in position.

20. The method of claim 15 which includes folding the end portions to a downward position from said base portion; and inserting said sheet material with the article immobilized on the base portion into a container to position the immobilized article above the bottom level of the container.

21. The method of claim 15 which includes:

a) employing a transparent plastic film tube;

b) folding the end portions to a downward position; and c) displaying the article immobilized on the base portion.

* * * * *